US011608583B2

(12) United States Patent
Chiorino et al.

(10) Patent No.: US 11,608,583 B2
(45) Date of Patent: Mar. 21, 2023

(54) WASHING DRUM UNIT WITH A JET SPRAY

(71) Applicant: Whirlpool Corporation, Benton Harbor, MI (US)

(72) Inventors: Carlo Chiorino, Buguggiate (IT); Mauro Mancini, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 34 days.

(21) Appl. No.: 17/221,302

(22) Filed: Apr. 2, 2021

(65) Prior Publication Data

US 2022/0316127 A1 Oct. 6, 2022

(51) Int. Cl.

| | |
|---|---|
| ***D06F 39/08*** | (2006.01) |
| ***D06F 23/02*** | (2006.01) |
| ***D06F 37/04*** | (2006.01) |
| ***D06F 37/26*** | (2006.01) |
| ***D06F 39/14*** | (2006.01) |

(52) U.S. Cl.

CPC ..... *D06F 39/088* (2013.01); *D06F 23/025* (2013.01); *D06F 37/04* (2013.01); *D06F 37/266* (2013.01); *D06F 39/14* (2013.01)

(58) Field of Classification Search

CPC ..... D06F 39/88; D06F 39/14; D06F 37/04; D06F 37/266; D06F 23/25

USPC ..... 68/28

See application file for complete search history.

(56) References Cited

U.S. PATENT DOCUMENTS

| | | | | |
|---|---|---|---|---|
| 4,580,421 | A | 4/1986 | Babuin et al. | |
| 6,981,395 | B2 | 1/2006 | Ryu et al. | |
| 9,222,209 | B2 | 12/2015 | Kim et al. | |
| 2006/0081018 | A1 | 4/2006 | Kim | |
| 2019/0338455 | A1* | 11/2019 | Garnek | D06F 37/06 |
| 2019/0368101 | A1 | 12/2019 | Budicky et al. | |
| 2020/0378050 | A1* | 12/2020 | Angelini | D06F 37/30 |

FOREIGN PATENT DOCUMENTS

| | | | |
|---|---|---|---|
| CN | 1207427 | A | 2/1999 |
| CN | 107354660 | A | 11/2017 |
| CN | 109338668 | A | 2/2019 |
| CN | 109652952 | A | 4/2019 |
| DE | 4413613 | C1 | 5/1995 |

(Continued)

OTHER PUBLICATIONS

European Search Report for 22165640.8-1016, dated Sep. 6, 2022 (97 Pages).

*Primary Examiner* — Tinsae B Ayalew

(74) *Attorney, Agent, or Firm* — Harness, Dickey & Pierce PLC

(57) ABSTRACT

A washing machine has a rotatable drum including a cylindrical wall and a base at one end on the cylindrical wall. The base includes a projecting member to space clothes in the drum from the base. At least one slot is in the base to enable passage of water into the drum. A tub includes a cylindrical wall and a base at one end of the cylindrical wall. The tub receives the rotatable drum within the cylindrical wall. The tub includes a water inlet in line with the at least one slot so that as the at least one slot is aligned with the water inlet, water is sprayed into the drum. A meshing arrangement is positioned between the drum base and the tub base to reduce a gap between the drum and tub and provide a forced passage maintaining the water at the inlet.

20 Claims, 4 Drawing Sheets

(56) References Cited

FOREIGN PATENT DOCUMENTS

| | | | |
|---|---|---|---|
| EP | 2138626 | A1 | 12/2009 |
| EP | 2392720 | A1 | 12/2011 |
| EP | 3309290 | A1 | 4/2018 |
| FR | 2703370 | A | 10/1994 |
| JP | 4092697 | A | 3/1992 |

* cited by examiner

WASHING DRUM UNIT WITH A JET SPRAY

FIELD

The present disclosure relates to washing appliances, such as a washing machine, that includes a jet spray from the back side of the drum unit.

BACKGROUND

In current washing machines, the procedure to wet and rinse clothes positioned inside the drum unit is to pump water from the tub bottom side. Gradually, the water level rises reaching the clothes to be wetted or rinsed. This process, although very simple, is often times time consuming and ineffective. This is due to the fact that the bottom portion of the tub needs to be filled before the water level reaches the clothes. Accordingly, this is an inefficient and an ineffective way of the wetting/rinsing phase of adding water to the tub.

In prior art washing machines, jet spray from the back side of the drum uses a complex dedicated drum and tub configurations. These configurations include cavities and pipes that need to be preventably filled with water. This increases the required pumping capacity. Additionally, since some of the features are assembled on the drum, the dynamic performance is affected due to the increased inertia. See U.S. Pat. No. 6,981,395 B2 and U.S. Publ. No. 2006/0081018 A2.

Accordingly, it is an object of the present disclosure to overcome the shortcomings of the prior art references. The present disclosure provides a simple design providing a jet spray from the drum rear and tub assembly. The present disclosure eliminates attached features to the drum therefore eliminating the increased inertia effect. Also, the present disclosure provides modifications to the drum back to provide a jet spray.

SUMMARY

According to a first object of the disclosure, a drum and tub assembly for a washing machine comprises a rotatable drum including a cylindrical wall and a base at one end of the cylindrical wall. The base includes a projecting member to space clothes in the drum from the base. At least one slot or aperture is in the base. The at least one slot or aperture enables the passage of water into the drum. A tub includes a cylindrical wall and a base at one end. The tub receives the rotating drum within its cylindrical wall. The tub includes a water inlet aligned with the at least one slot or aperture so that as the at least one slot or aperture is aligned with the water inlet, water is sprayed into the drum. A meshing arrangement is positioned between the drum base and the tub base. The meshing arrangement reduces a gap between the drum and tub to provide a force passage to maintain the water at the inlet. The projection member includes a plurality of propeller-like members. The drum base includes a plurality, preferably three arcuate slots. The meshing arrangement includes a plurality of projections on the drum and tub. The projections are concentric. Also, the projections are spaced with respect to one another to provide an interleaving or alternating arrangement of the projections. Thus, the projections form a labyrinth seal.

According to a second object of the disclosure, a washing machine comprises a housing unit to receive a drum and tub assembly. A door is coupled with the housing to enable access into the drum and tub assembly. The drum and tub assembly comprising a rotatable drum including a cylindrical wall and a base at one end of the cylindrical wall. The base includes a projecting member to space clothes in the drum from the base. At least one slot or aperture is in the base. The at least one slot or aperture enables the passage of water into the drum. A tub includes a cylindrical wall and a base at one end. The tub receives the rotating drum within its cylindrical wall. The tub includes a water inlet aligned with the at least one slot or aperture so that as the at least one slot or aperture is aligned with the water inlet, water is sprayed into the drum. A meshing arrangement is positioned between the drum base and the tub base. The meshing arrangement reduces a gap between the drum and tub to provide a force passage to maintain the water at the inlet. The projection member includes a plurality of propeller-like members. The drum base includes a plurality, preferably three arcuate slots. The meshing arrangement includes a plurality of projections on the drum and tub. The projections are concentric. Also, the projections are spaced with respect to one another to provide an interleaving or alternating arrangement of the projections. Thus, the projections form a labyrinth seal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
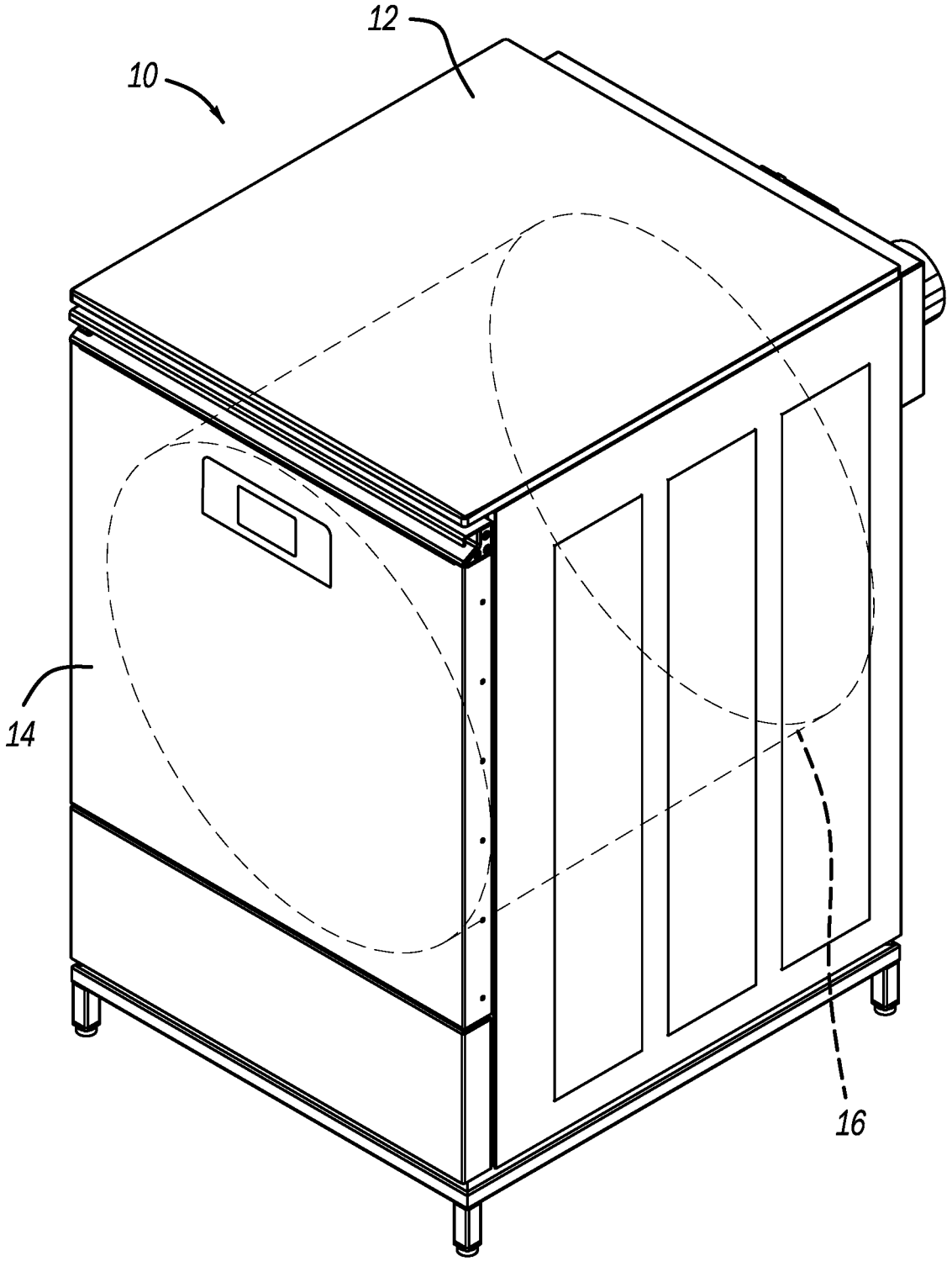
FIG. 1 is a perspective view of a washing machine appliance.
Figure 2:
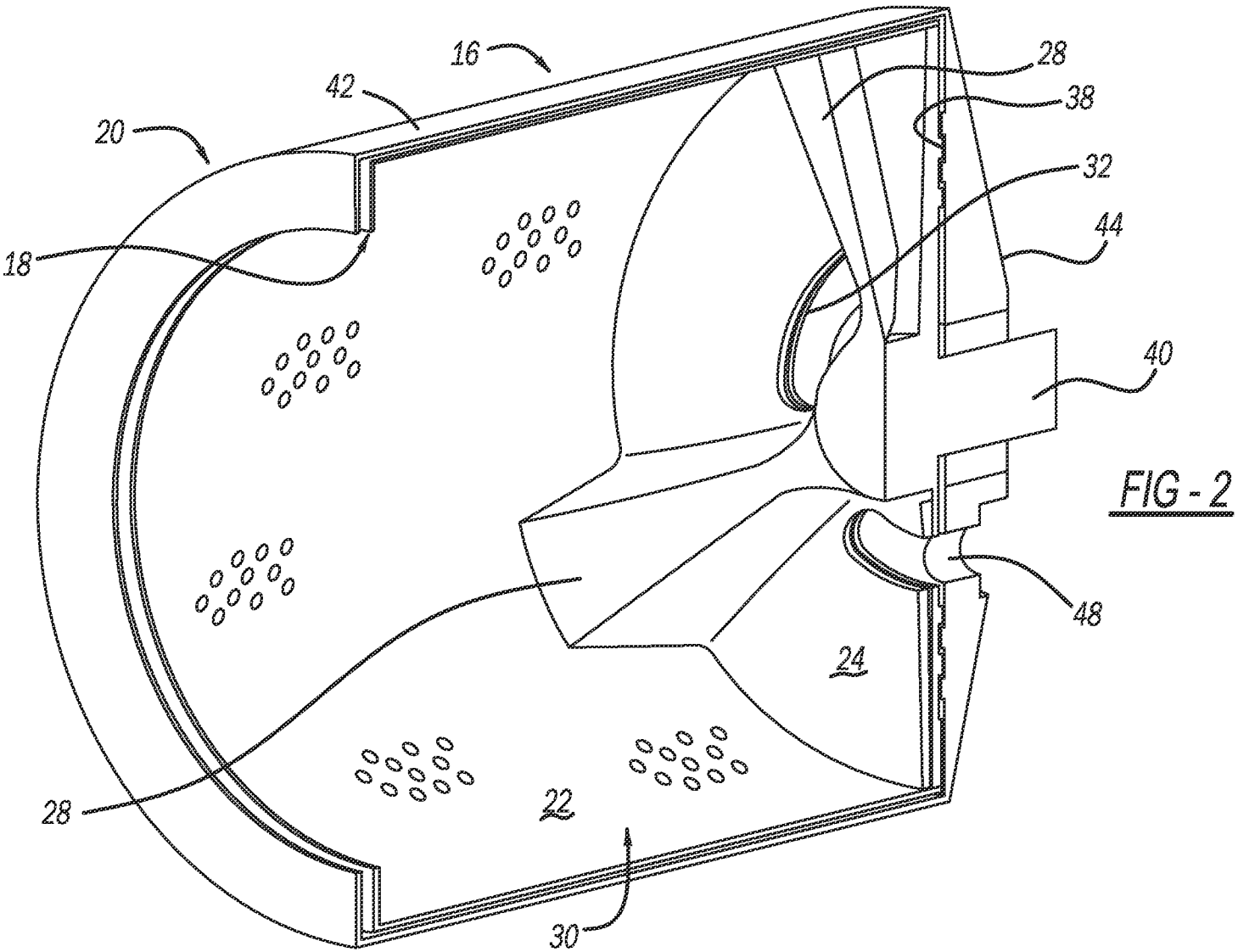
FIG. 2 is a cross-section view of the tub and drum assembly.
Figure 3:
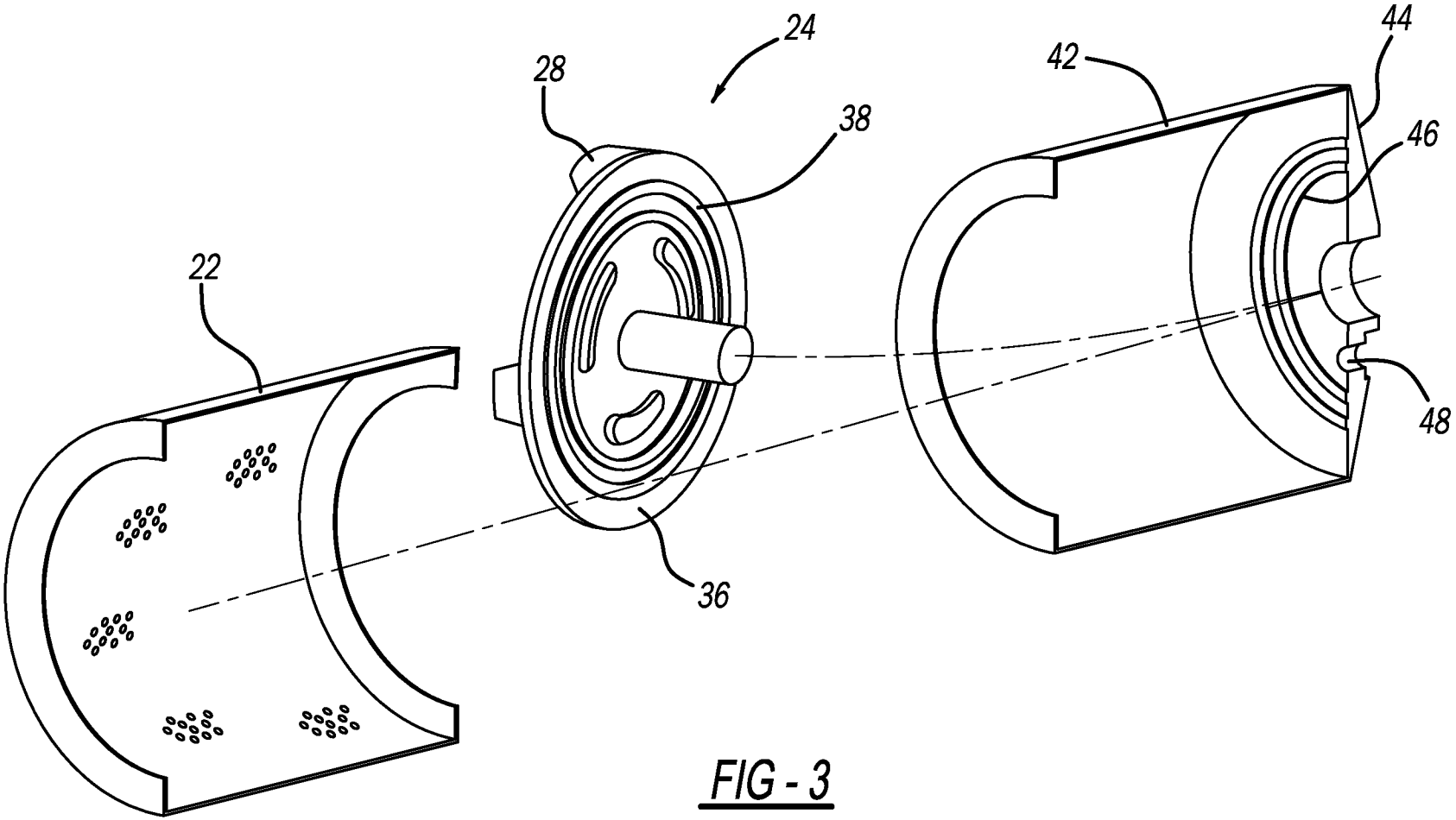
FIG. 3 is a perspective exploded view of the tub and drum assembly.

Example embodiments will now be described more fully with reference to the accompanying drawings.

Turning to the figures, a washing machine is illustrated and designated with the reference numeral 10. The washing machine 10 includes a housing unit 12 with a door 14 enabling access inside of the machine 10. A drum and tub assembly 16 is positioned inside of the housing unit 12.

The drum and tub assembly 16 includes a drum 18 positioned within a tub 20. The drum 18 includes a cylindrical wall 22 and a drum base 24 at one end. The other end of the drum 18 is opened to enable receipt of clothes. The drum base 24 includes a plurality of projections 28 on its inner surface extending into an interior cavity 30 defined by the cylindrical wall 22 and drum base 24. The projections 28 provide the drum base 24 with an overall propeller like shape. The projections 28 space clothes from the back of the drum base 24. Thus, as the drum 18 rotates, the clothes are spaced away from the base 24. The drum base 24 includes at least one arcuate slot 32. As shown, three slots 32 are present. The slots or apertures 32 enable water to be sprayed into the drum 18, while it rotates, to provide a spray jet for the drum 18. The outer surface 36 of the drum base 24 includes at least one meshing projection 38. The projections 38 mesh with like projections on the tub 20 as will be discussed herein. Also, the drum 18 includes a shaft 40 that fits through the tub 20 and is connected with a motor to rotate the drum 18 within the tub 20.

The tub 20 includes a cylindrical wall 42 and a tub base 44. The tub 20 is stationarily positioned within the washing machine 10. The tub base 44 includes at least one projection 46 that is positioned to mesh with the drum projections 38. Thus, an interleaved or alternating set of projections 38, 46 are positioned adjacent one another. These projections 38, 46 provide a labyrinth type of seal. The projections 38, 46 are arranged as a meshing arrangement to reduce the gap between the drum 18 and tub 20 to provide a force passage to maintain water at water inlet 48.

Figure 4:
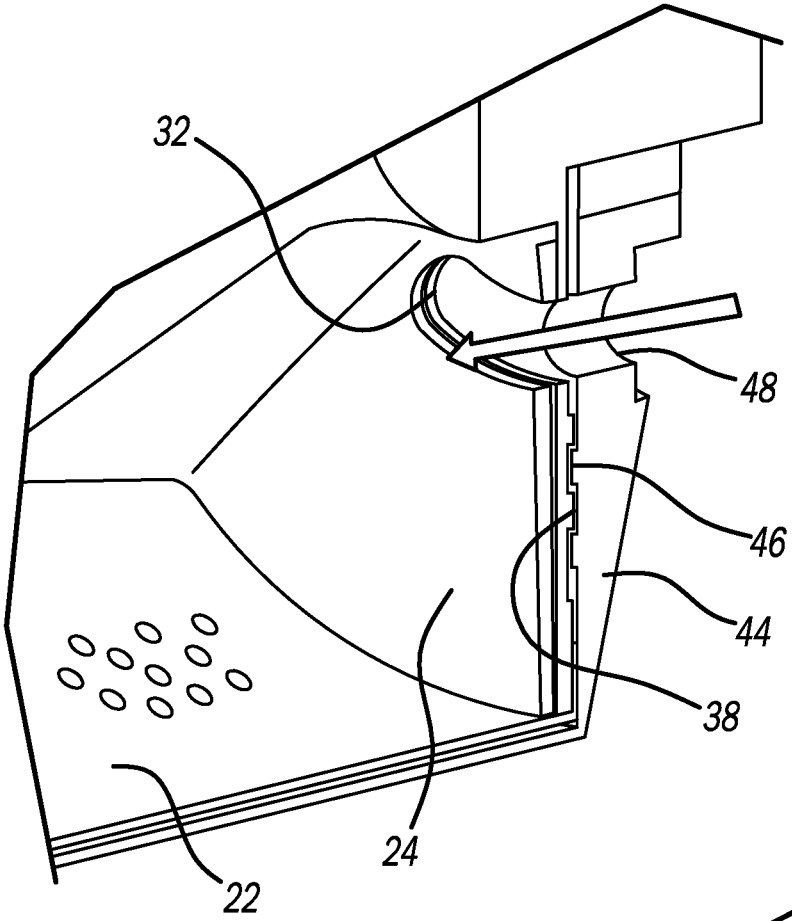
FIG. 4 is an enlarged perspective partially in cross-section of the inlet with a slot aligned with the inlet.
Figure 5:
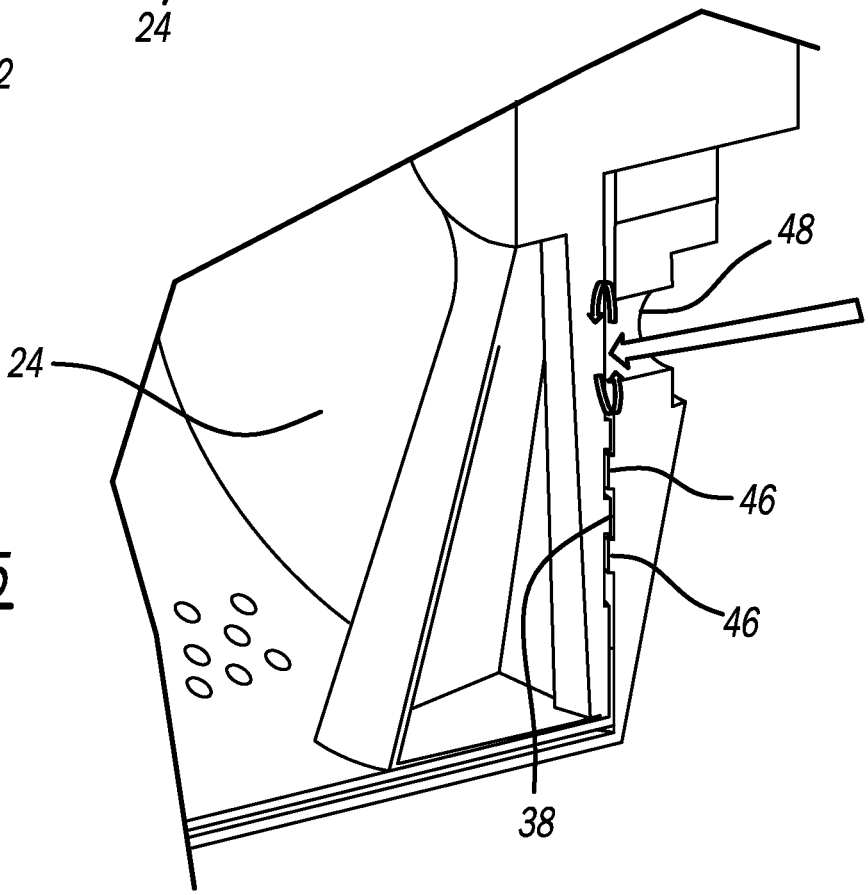
FIG. 5 is a view like FIG. 4 without alignment.

The water inlet 48 projects through the tub base 44 and is coupled with a water source, which sprays water into the drum 18. The water inlet 48 can have a cylindrical or conical type of surface to inject the water into the drum 18 through the slots 32 in the drum base 24. As seen in FIGS. 4 and 5, when the water inlet 48 is aligned with the slots 32, water is sprayed into the drum 18. As the drum 18 continues to rotate, the slots 32 are not aligned with the water inlet 48 as illustrated in FIG. 5. When this occurs, the water is maintained around the water inlet 48 due to the meshing arrangement of the projections 38, 46 providing the labyrinth seal. Additionally, if water seeps below the meshing arrangement, the water will be able to seep into the drum 18 via holes in the cylindrical wall 22 the drum 18 that are not shown.

What is claimed is:

1. A drum and tub assembly for a washing machine comprising:

a rotatable drum including a cylindrical wall and a drum base at one end of the cylindrical wall, the drum base including a projecting member and at least one slot in the drum base;

a tub including a cylindrical wall and a tub base at one end of the cylindrical wall, the tub receiving the rotatable drum within the cylindrical wall, the tub base including a water inlet; and a meshing arrangement between the drum base and the tub base, the meshing arrangement reducing a gap between the rotatable drum and the tub, wherein rotation of the rotatable drum causes the water inlet in the tub base to come into alignment with the at least one slot in the drum base and spray water into the rotatable drum through the at least one slot, and as the rotatable drum continues to rotate, the at least one slot is rotated out of alignment with the water inlet such that water is restricted from entering the at least one slot and water is maintained around the water inlet due to the meshing arrangement.

2. The drum and tub assembly of claim 1, wherein the rotatable drum has an interior cavity for receiving clothes and the at least one slot in the drum base is open to and communicates directly with the interior cavity of the rotatable drum.

3. The drum and tub assembly of claim 1, wherein the at least one slot in the drum base includes three slots.

4. The drum and tub assembly of claim 1, wherein the at least one slot is arcuate.

5. The drum and tub assembly of claim 1, wherein the meshing arrangement includes a plurality of projections on the drum base and the tub base.

6. The drum and tub assembly of claim 5, wherein the projections are concentric.

7. The drum and tub assembly of claim 6, wherein the projections are spaced with respect to one another providing an alternating arrangement.

8. The drum and tub assembly of claim 6, wherein the projections form a labyrinth seal.

9. The drum and tub assembly of claim 5, wherein the projections form an interleaved set of projections that are positioned adjacent to one another.

10. The drum and tub assembly of claim 1, wherein the at least one slot enables water to be sprayed into the rotatable drum, while the rotatable drum rotates, to provide a spray jet of water into the rotatable drum.

11. A washing machine comprising:

a housing receiving a rotatable drum and a tub;

a door coupled with the housing for enabling access to the rotatable drum;

the rotatable drum includes a cylindrical wall and a drum base at one end of the cylindrical wall, the drum base includes a projecting member and at least one slot in the drum base;

the tub includes a cylindrical wall and a tub base at one end of the cylindrical wall, the tub receives the rotatable drum within the cylindrical wall, and the tub base includes a water inlet;

a shaft extending through the tub and connected with a motor that is configured to rotate the rotatable drum within the tub;

the at least one slot in the drum base is radially spaced from the shaft and rotates into alignment with the water inlet in the tub base where water flows through the at least one slot and into the rotatable drum, and as the at least one slot continues to rotate, the at least one slot is rotated out of alignment with the water inlet such that water is restricted from flowing through the at least one slot; and a meshing arrangement positioned between the drum base and the tub base, the meshing arrangement reducing a gap between the rotatable drum and tub and when the at least one slot is rotated out of alignment with the water inlet, the meshing arrangement providing a forced passage for maintaining water at the water inlet.

12. The washing machine of claim 11, wherein the rotatable drum has an interior cavity for receiving clothes and the at least one slot in the drum base is open to and communicates directly with the interior cavity of the rotatable drum.

13. The washing machine of claim 11, wherein the at least one slot of the drum base includes three slots.

14. The washing machine of claim 11, wherein the at least one slot is arcuate.

15. The washing machine of claim 11, wherein the meshing arrangement includes a plurality of projections on the drum base and the tub base.

16. The washing machine of claim 15, wherein the projections are concentric.

17. The washing machine of claim 16, wherein the projections are spaced with respect to one another providing an alternating arrangement.

18. The washing machine of claim 16, wherein the projections form a labyrinth seal.

19. The washing machine of claim 15, wherein the projections form an interleaved set of projections that are positioned adjacent to one another.

20. The washing machine of claim 11, wherein the at least one slot enables water to be sprayed into the rotatable drum, while the rotatable drum rotates, to provide a spray jet of water into the rotatable drum.

* * * * *